United States Patent [19]

Anderson

[11] 4,028,849

[45] June 14, 1977

[54] WINDOW STRUCTURE

[75] Inventor: Richard N. Anderson, Owensboro, Ky.

[73] Assignee: V. E. Anderson Mfg. Co., Owensboro, Ky.

[22] Filed: Mar. 5, 1974

[21] Appl. No.: 448,257

Related U.S. Application Data

[60] Division of Ser. No. 121,985, March 8, 1971, Pat. No. 3,795,076, and a continuation-in-part of Ser. No. 36,303, June 22, 1970, Pat. No. 3,711,995.

[52] U.S. Cl. ..... 49/181; 49/446; 49/453

[51] Int. Cl.[2] ..... E05D 15/22

[58] Field of Search ..... 49/181, 446, 454, 453, 49/455

[56] References Cited

UNITED STATES PATENTS

| | | | |
|---|---|---|---|
| 3,498,000 | 3/1970 | Nobes | 49/446 |
| 3,842,540 | 10/1974 | Anderson | 49/181 |

FOREIGN PATENTS OR APPLICATIONS

| | | | |
|---|---|---|---|
| 1,039,109 | 8/1966 | United Kingdom | 49/446 |

*Primary Examiner*—Kenneth Downey
*Attorney, Agent, or Firm*—Whittemore, Hulbert & Belknap

[57] ABSTRACT

Universal window structure for use as a single-hung window, a hopper window, or a right or left-hand glider window and having a box frame and at least one movable sash is disclosed.

An improved mull cover for securing a plurality of the universal window structures together, sash guide and tilt release structure for permitting tilting of the movable sash out of the plane of the window structure, and sash guide and pivot structure for the movable sash are also disclosed, together with an improved sash balance shoe, improved locking structure for the movable sash, improved glazing structure, improved weather stripping, structure for maintaining the weathertightness of the window structure during high winds, and a combination screen retainer and movable sash seal. The window structure of the invention may be installed from the inside of a window opening by means of unique installation clips and can be installed from the exterior of a window opening in conjunction with a unique installation bracket. Trim extensions are also provided with the window structure for finishing a window opening in which the window structure is installed.

The window structure of the invention has provision for weepage installed as a single-hung hopper or as a right or left-hand glider window. The movable sash of the window structure of the invention is separated from the frame thereof and guiding and spacing means to eliminate metal-to-metal engagement between the movable sash and the window frame are provided whereby the window structure is particularly quiet in operation.

22 Claims, 41 Drawing Figures

22
378
46
98
100
96
102
106
30
12
108
104
20
120
86
118
122
90
16
28
18
68
26
40
42
44
308
38
470
110
112
114
276
274
36
14
162
188
88
92
244
34
32
310
246
252
254
24
242
10

FIG.2
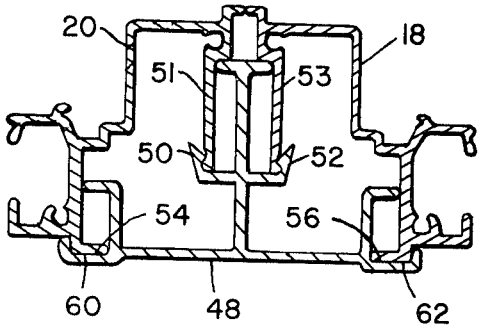
FIG.3
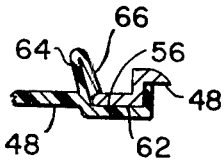
FIG.3A
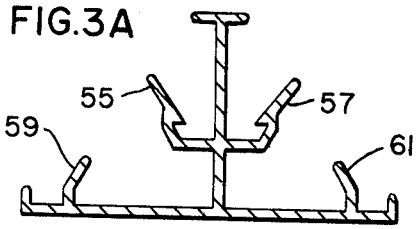
FIG.4
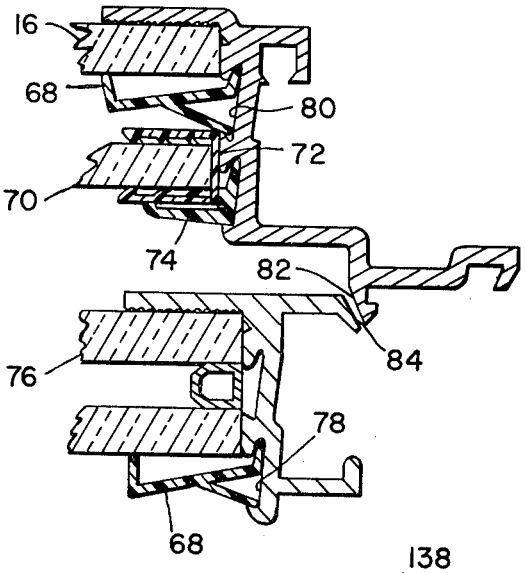
FIG.5
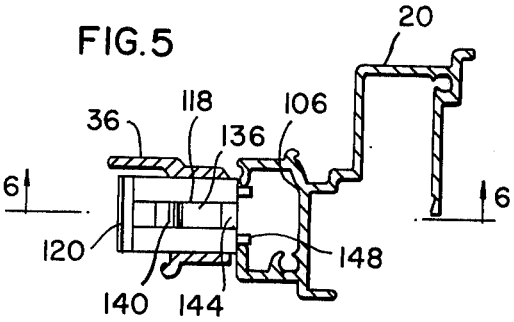
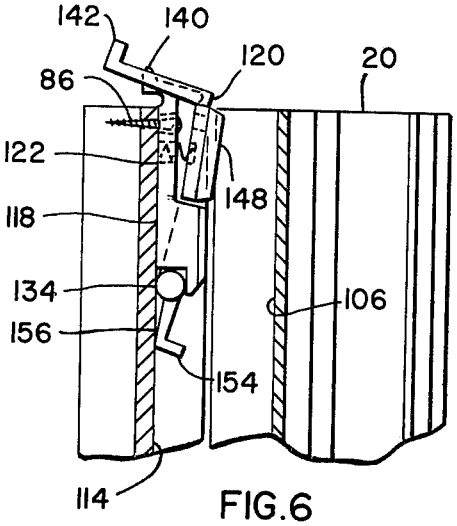
FIG.6
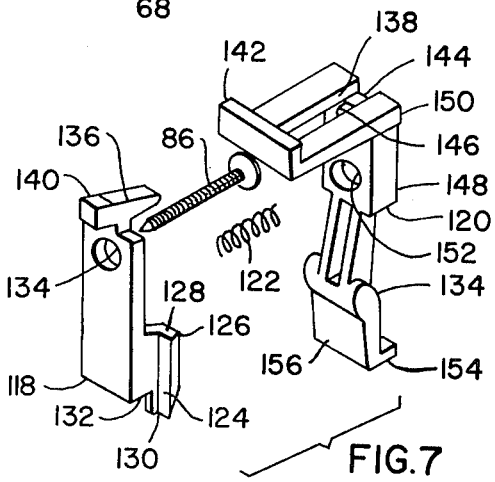
FIG.7

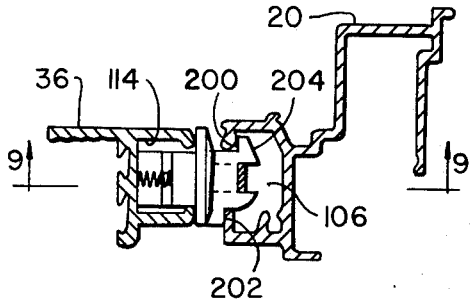
FIG.8
FIG.10
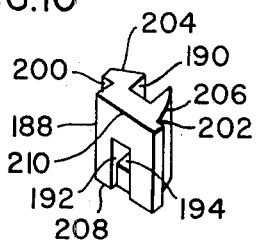
FIG.9
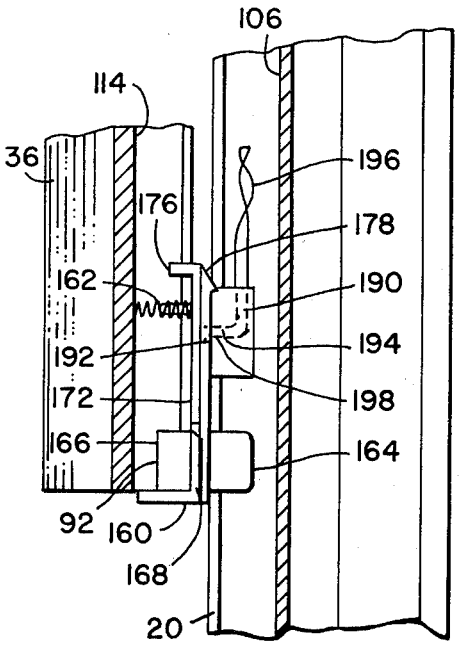
FIG.11
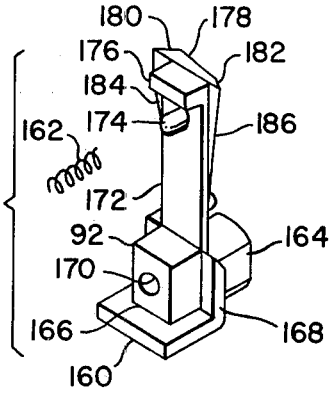
FIG.13
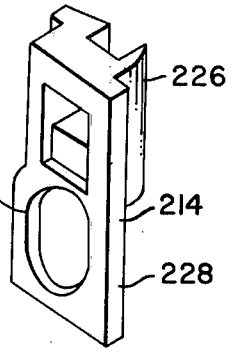
FIG.14
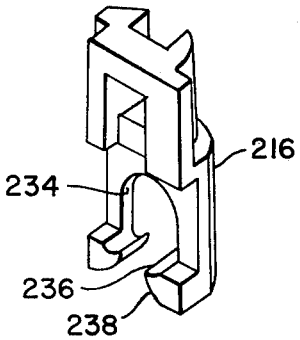
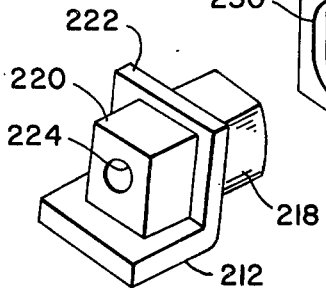
FIG.12

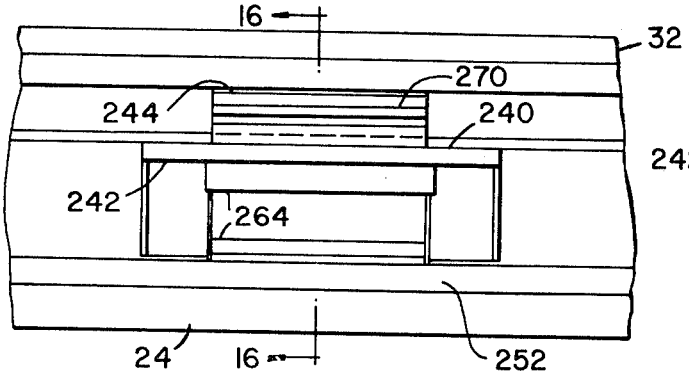
FIG.15
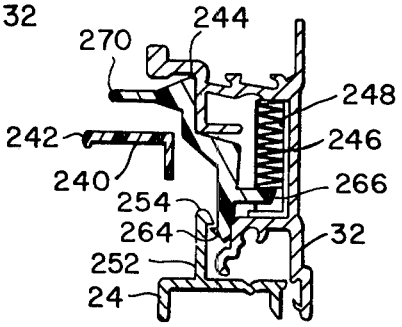
FIG.16
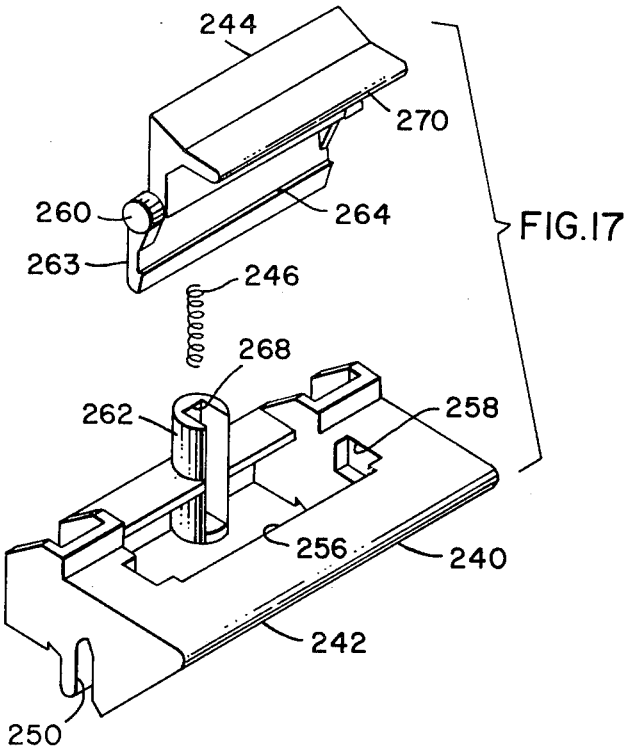
FIG.17
FIG.18
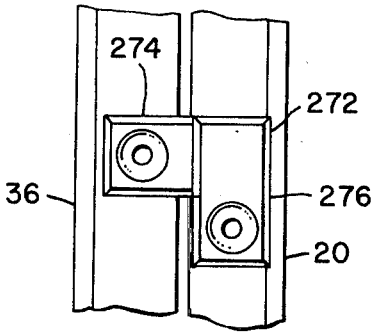
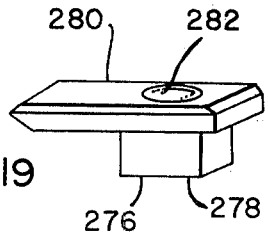
FIG.19
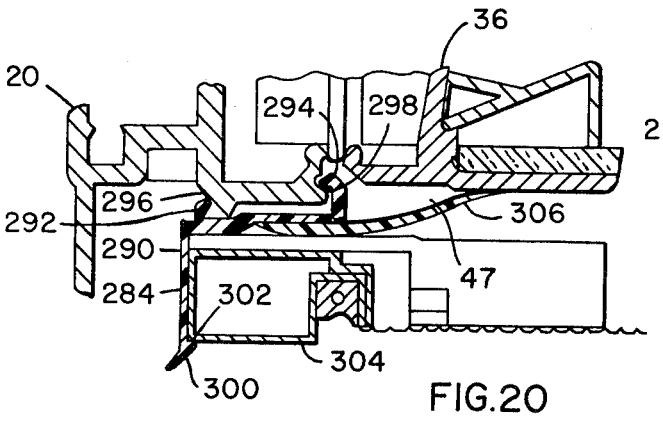
FIG.20
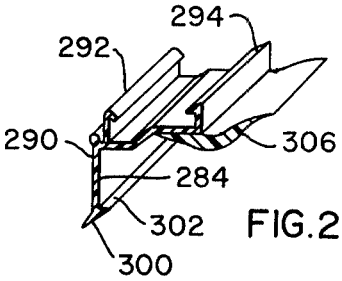
FIG.21

FIG.22
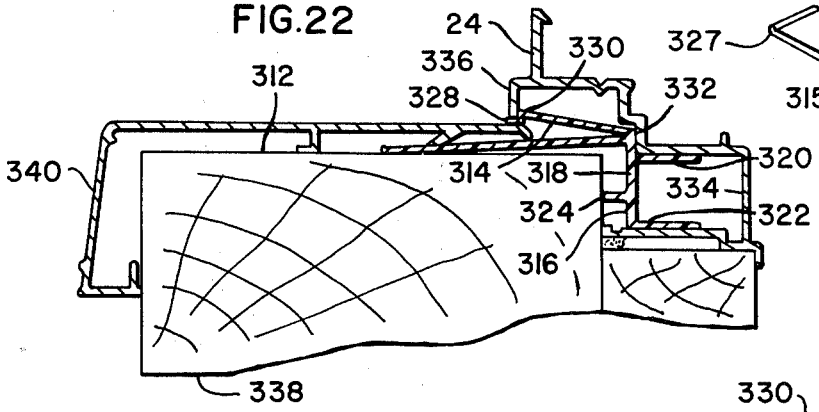
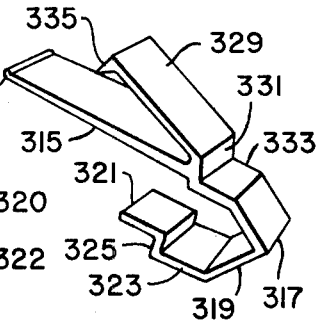
FIG.25
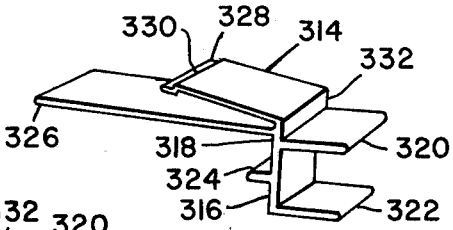
FIG.24
FIG.23
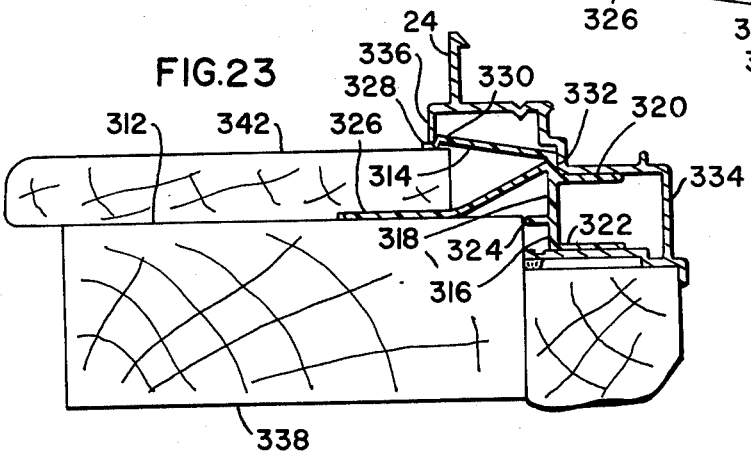
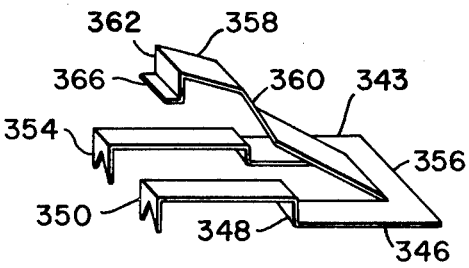
FIG.27
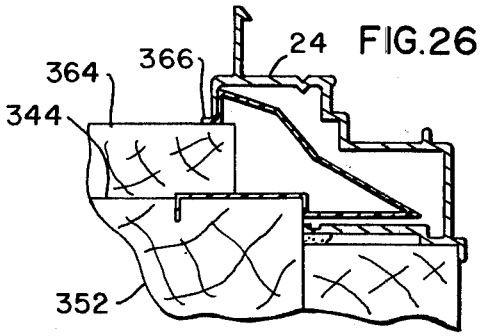
FIG.26
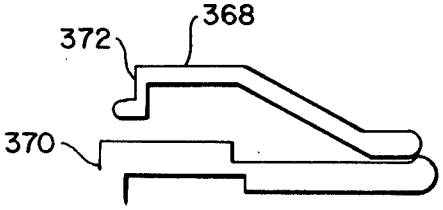
FIG.28

FIG.29
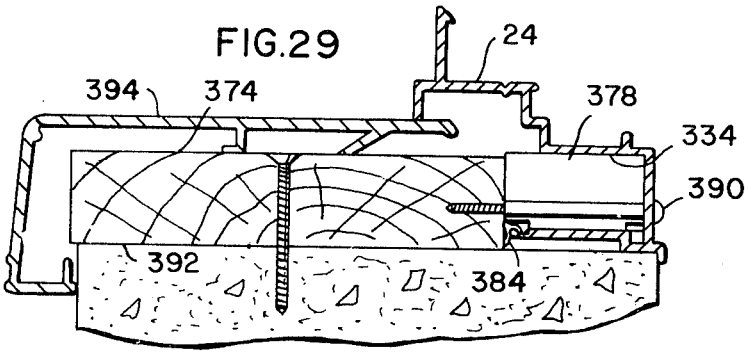
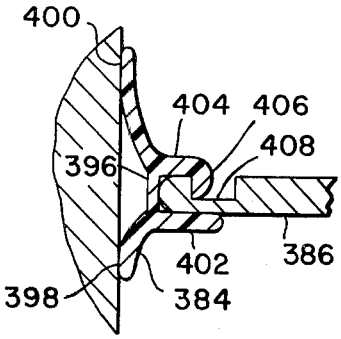
FIG.32
FIG.30
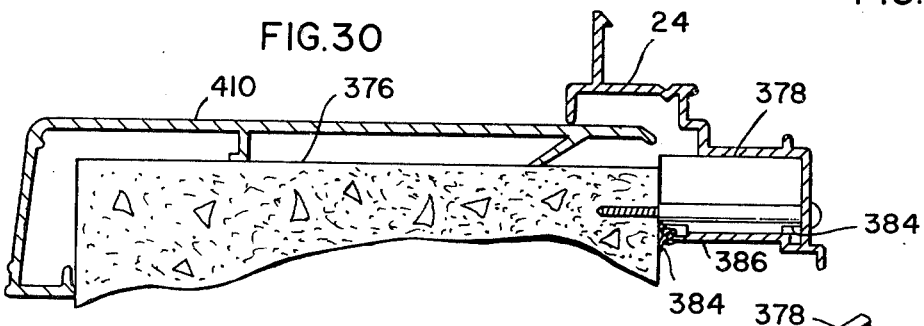
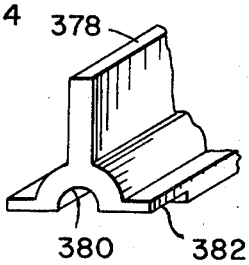
FIG.31
FIG.33
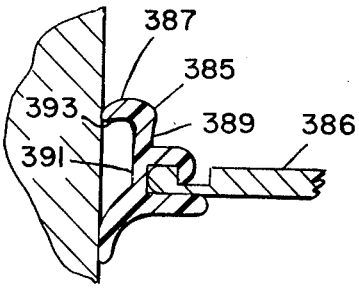
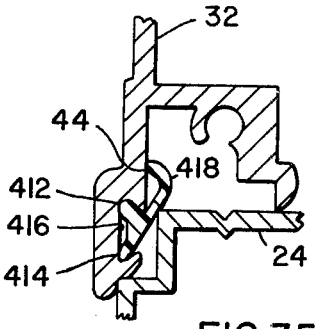
FIG.35
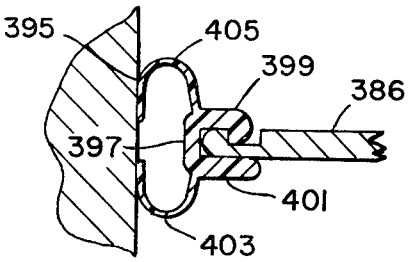
FIG.34

FIG.36
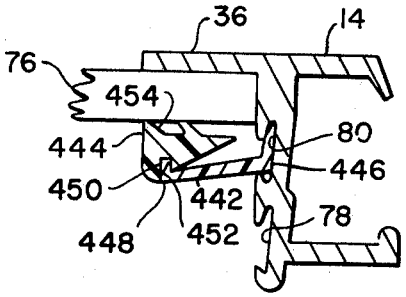
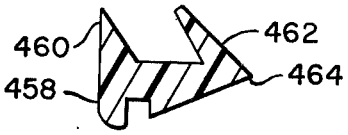
FIG.37
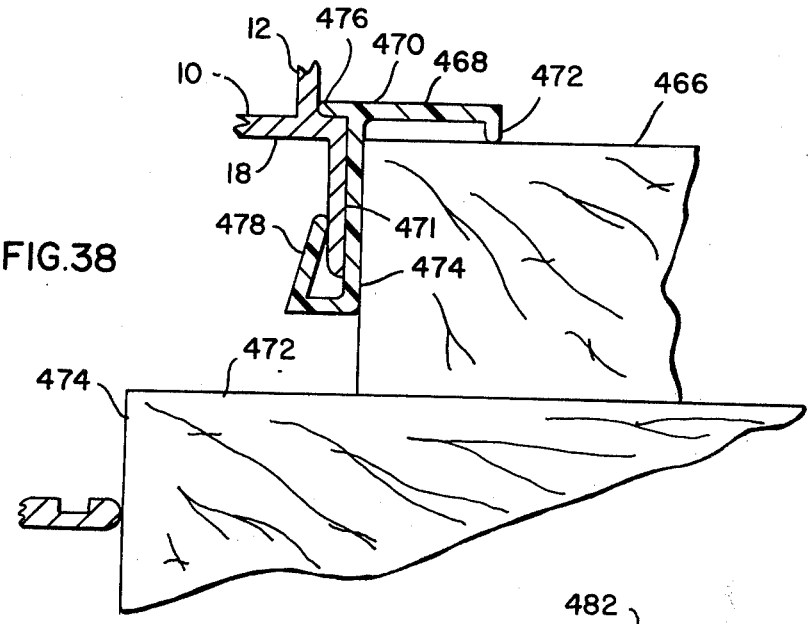
FIG.38
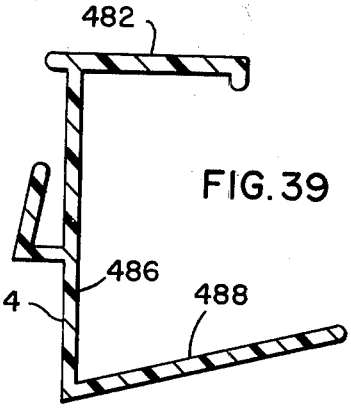
FIG.39
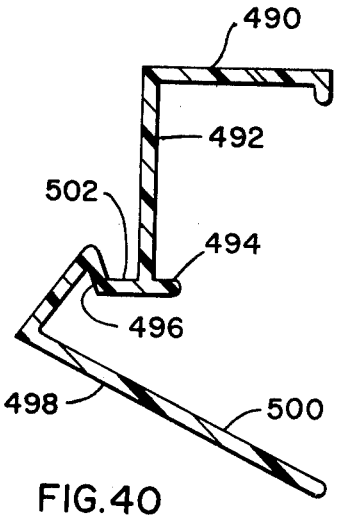
FIG.40

WINDOW STRUCTURE

CROSS REFERENCE TO RELATED APPLICATIONS

The present application is a division of application Ser. No. 121,985, filed Mar. 8, 1971, now U.S. Pat. No. 3,795,076, and is related to applications Ser. No. 7,452, filed Feb. 2, 1970, now U.S. Pat. No. 3,686,818 and Ser. No. 38,453, filed May 18, 1970, now U.S. Pat. No. 3,824,752, which disclose false muntin structure and storm sash structure, respectively, for use with window structure such as disclosed herein in more detail. Further, the present application is a continuation-in-part of U.S. patent application Ser. No. 36,303, filed June 22, 1970 now U.S. Pat. No. 3,711,995.

BACKGROUND OF THE INVENTION

1. Field of the Invention

The invention relates to building structure and refers more specifically to a prime window which is suitable for use as a single-hung window, a hopper window, or a right or left-hand glider window without modification of the basic window structure. The window structure includes a box frame construction for strength and appearance, constructed to prevent metal-to-metal contact in operation whereby operation of the window structure is effected without galling of the parts thereof, a unique mull cover for mulling adjacent window structures, improved movable sash guide and tilt release structure, movable sash guide and pivot structure, movable sash lock structure, structure for maintaining the seal of the movable sash in high winds, and improved weather stripping structure along with unique installation clips and brackets for economical, efficient installation of the window structure from either the interior or exterior of a window opening.

2. Description of the Prior Art

In the past, window structure has generally been designed for a single use. That is, it has been designed, for example, as a single-hung window, as a hopper window, or as a glider window. Such single-purpose windows require large dealer inventories to meet demand for each type of window, which is undesirable. In addition, multipurpose window structures of the past have generally had complicated frame sections which were less strong and less aesthetically pleasing than desirable. At times the frame sections of previous window structures have had metal-to-metal contact in at least one of their multiple uses whereby operation of the window structure caused galling of the parts thereof and was noisy. Also, the mulling of a plurality of multipurpose windows together in the past has sometimes been difficult and unsatisfactory in appearance.

In addition, the hardware of multipurpose window structures in the past has generally been complicated and therefore expensive and often inefficient. This is particularly true of sash guide and tilt release structure, sash guide and pivot structure, sash balance shoes, lock means for movable sash, hurricane clips and the like.

Due to the requirement for movable sash of multipurpose window structure to tilt freely so that the movable sash cannot run in tracks in the window frame, multipurpose windows of the past have been extremely difficult to seal tightly and weather stripping therefor has often been inefficient. Installation of even single-purpose windows in the past has usually not been possible from the interior of a window opening and separate clips have generally been required for installation of screens on both single and multipurpose windows of the past.

In view of these deficiencies of prior window structures, a multipurpose window structure in which the frame is strong and aesthetically pleasing, is so constructed as to be easily mulled and cause no galling of parts thereof in operation, and in which sash guide and tilt release structure, sash guide and pivot structure, sash balance and lock hardware are particularly simple and therefore economical and efficient, is needed. To provide such a multipurpose window wherein the window is easily sealed even with regard to high-force winds yet has provision for weepage in all positions of use thereof and which includes integral means for securing a screen thereto and may be simply and rapidly installed from either the interior or exterior of a window opening, is therefore desirable.

SUMMARY OF THE INVENTION

In accordance with the invention, there is provided a universal window structure which may be used as a single-hung window, as a hopper window, and as a right or left-hand glider window without alteration. The window structure of the invention includes a box frame for strength and appearance including members contoured to prevent metal-to-metal contact with the window structure in use so that the window operates quietly and without galling. The window structure of the invention further includes a mull cover which permits a single workman to mull adjacent window structures.

Further, in accordance with the invention, the sash guide and tilt release structure associated with a movable sash, sash guide and pivot structure, as well as the sash balance shoe and movable sash lock structure, are particularly simple, economical and efficient. The window structure of the invention also includes novel sealing means including unique weather strips and a sash sealing strip including means for retaining a window screen constructed integral therewith. Installation clips and brackets are also provided whereby the window structure of the invention may be rapidly and easily installed from either the interior or exterior of a window opening.

In particular, in the universal window structure of the invention, the movable sash has been separated from the frame so that the sash guide rails no longer move in a frame channel and may be termed to be "floating" in the window frame. Guiding, tilt release and pivot structure have been constructed to space the sash from the frame and both the sash and frame have been so contoured as to prevent metal-to-metal contact and subsequent galling of the window structure members and noise during operation of the window.

In addition, structure for maintaining the window sash and frame in structural engagement centrally of the window sash guide rails with the movable sash closed has been provided whereby the strength of the window sash guide rails is increased approximately 800 percent in view of the relative stiffness of the guiding frame rails, which structure requires no operation other than the normal opening of the movable sash to disengage the sash from the frame and normal closing of the movable sash to engage the sash with the frame so that no special knowledge or instruction is necessary to provide the added sash guide rail strength.

In addition, inasmuch as the universal window structure of the invention is intended for use with either guiding frame rails or the locking frame rail in a lower position, weepage channels and passages have been constructed in the window structure to permit weepage with the window installed in each of the intended positions thereof. The weepage is permitted in accordance with the present invention while maintaining a superior weather seal, particularly about the movable sash of the window structure. The weepage is provided by shrouded openings at the juncture of the guiding frame rails and the locking frame rail of the frame at both ends of the locking frame rail formed in conjunction with a combination weather strip, window screen retaining member extending over the guide rails of the movable sash and secured to the guiding frame rails.

Improved glazing structure including a separate retaining member and stuffer member is also part of the present invention along with trim structure for finishing the window structure particularly in dry wall installation of the window structure.

BRIEF DESCRIPTION OF THE DRAWINGS

FIG. 2 is an enlarged section view of a guiding frame rail of two adjacent window structures as shown in FIG. 1, particularly illustrating a metal mull cover constructed in accordance with the invention an assembly therewith.

FIGS. 3 and 3A illustrate modifications of the mull cover shown in FIG. 2.

FIG. 4 is an enlarged cross section of a frame adaptor member and a movable sash guide rail of the window structure illustrated in FIG. 1, constructed to prevent metal-to-metal contact therebetween and illustrating a fixed single pane glazing panel and a removable storm sash fixed in the window structure along with a double pane glazing panel in the movable window sash of the window structure, both of which glazing panels are glazed with a universal glazing strip.

FIG. 5 is an enlarged cross section of a guiding frame rail of the window frame and a top view of a movable sash guide rail of the window structure illustrated in FIG. 1, showing sash guide and tilt release structure in assembly therewith.

FIG. 6 is a section view of the window guiding frame rail and movable sash guide rail shown in FIG. 5 with the sash guide and tilt release structure in assembly therewith, taken substantially on the line 6—6 in FIG. 5.

FIG. 7 is an exploded perspective view of the sash guide and tilt release structure illustrated in FIGS. 5 and 6.

FIG. 8 is an enlarged section view of a guiding frame rail and movable sash guide rail of the window structure illustrated in FIG. 1, showing a sash guide and pivot member and a sash balance shoe in assembly therewith.

FIG. 9 is a section view of the sash guide rail and guiding frame rail shown in FIG. 8, with a sash guide and pivot structure and a sash balance shoe in assembly therewith, taken substantially on the line 9—9 in FIG. 8.

FIG. 10 is a perspective view of the sash balance foot illustrated in FIGS. 8 and 9.

FIG. 11 is an exploded perspective view of the sash guide and pivot structure illustrated in FIGS. 8 and 9.

FIG. 12 is an enlarged perspective view of modified sash guide and pivot structure for use with the sash balance shoe modifications illustrated in FIGS. 13 and 14.

FIGS. 13 and 14 are enlarged perspective views of a modified sash balance shoes.

FIG. 15 is an enlarged inside elevation view of a portion of the lock rail of the movable sash of the window structure illustrated in FIG. 1, showing the lock structure for the movable sash.

FIG. 16 is a section view of the movable sash lock rail and lock mechanism of the window structure of FIG. 1, taken substantially on the line 16—16 in FIG. 15.

FIG. 17 is an exploded perspective view of the lock structure illustrated in FIGS. 15 and 16.

FIG. 18 is an enlarged elevation view of a portion of a guiding frame rail and of the sash guide rail of the window structure illustrated in FIG. 1, showing high wind retaining clips in assembly therewith.

FIG. 19 is an enlarged perspective view of a high wind retaining clip as illustrated in FIG. 18.

FIG. 20 is an enlarged partial section view of a guiding frame rail and movable sash guide rail of the window structure illustrated in FIG. 1, particularly showing a combination sash weather seal and screen retainer clip strip in assembly therewith.

FIG. 21 is a reduced perspective view of the sash weather seal and screen retainer clip strip illustrated in assembly in FIG. 20.

FIGS. 22 and 23 are enlarged section views of the locking frame rail of the window structure illustrated in FIG. 1 installed in a building opening by means of an installation clip constructed in accordance with the invention and showing a window plastic and wood trim member in assembly therewith respectively.

FIG. 24 is a perspective view of the window structure installation clip illustrated in FIGS. 22 and 23.

FIG. 25 is a perspective view of a modification of the window installation clip illustrated in FIG. 24.

FIG. 26 is a section view similar to FIGS. 22 and 23 showing the installation of the window structure of FIG. 1 but illustrating a modified installation clip.

FIG. 27 is a perspective view of the modified installation clip illustrated in FIG. 26.

FIG. 28 is a perspective view of another modification of the installation clip illustrated in FIG. 26.

FIG. 29 is an enlarged section view of the locking frame rail of the window frame of the window structure illustrated in FIG. 1, installed in a window opening from the outside of the window opening in conjunction with an installation bracket and window trim.

FIG. 30 is another section view of the locking frame rail of the frame of the window structure illustrated in FIG. 1 installed in a different building opening from the exterior in conjunction with the installation bracket and an elongated extruded window trim member.

FIG. 31 is an enlarged partial perspective view of one end of the installation bracket illustrated in FIGS. 29 and 30.

FIG. 32 is an enlarged section view of a weather strip for use in the window structure illustrated in FIG. 1 between the frame and a window opening, as shown particularly in FIG. 29.

FIGS. 33 and 34 are section views of modifications of the weather strip illustrated in FIG. 32.

FIG. 35 is an enlarged section view of a weather strip for use in the window structure illustrated in FIG. 1 between the sash lock rail and window frame locking frame rail and between the window frame check rail and the tilt rail of the sash.

FIG. 36 is a section view of a sash guide rail illustrating modified sash glazing structure in use therewith.

FIG. 37 is a section view of a modified glazing stuffer member for use in the sash glazing structure illustrated in FIG. 36.

FIG. 38 is a cross section of a guiding frame rail of the window structure illustrated in FIG. 1 in assembly with a trim member constructed in accordance with the invention.

FIGS. 39 and 40 are section views of modifications of the trim member illustrated in FIG. 38.

DESCRIPTION OF THE PREFERRED EMBODIMENTS

Figure 1:
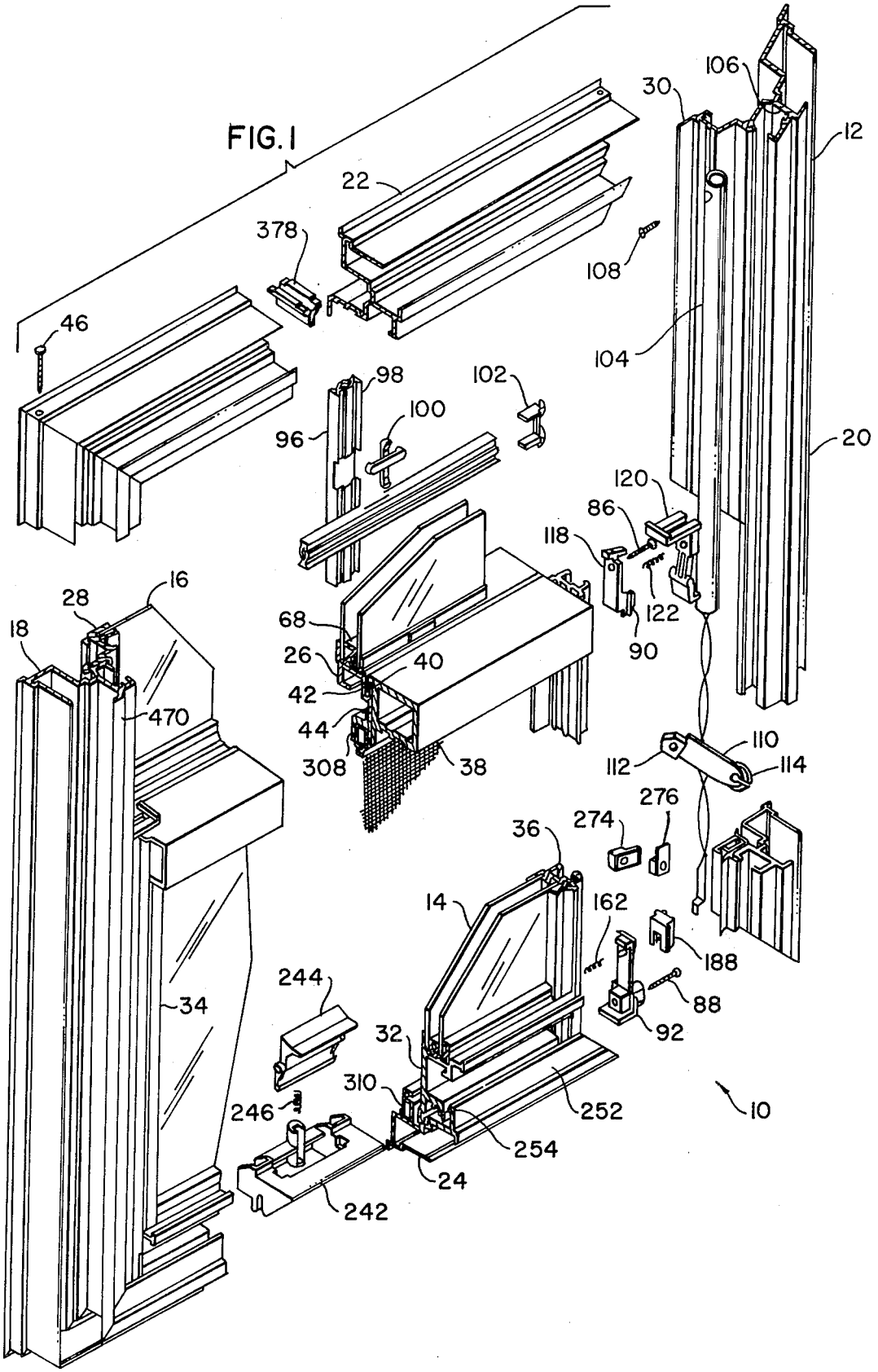
FIG. 1 is an exploded broken view of the universal window structure of the invention.

As shown in FIG. 1, the universal window structure 10 includes the frame 12 having a floating sash 14 movably positioned therein and a fixed glazing panel 16 secured thereto. The sash 14 may be moved parallel to the frame guide rails 18 and 20 to provide a single-hung window with the window structure 10 installed with the orientation illustrated in FIG. 1. The sash 14 may also be pivoted or tilted about the lock rail thereof to provide a hopper window when the window structure is installed with the orientation illustrated in FIG. 1. Installed with guiding frame rails 18 and 20 horizontal to the window structure 10 provides either a left or right-hand glider window.

Window frame 12 includes the guiding frame rails 18 and 20, the fixed frame rail 22, locking frame rail 24, and frame check rail 26. Frame adaptor members 28 and 30 are secured to the guiding frame rails 18 and 20, and in conjunction with the fixed frame rail 22 and frame check rail 26 receive the fixed glazing panel 16. The frame rails 18, 20, 22, 24, 26, 28 and 30 are all extruded in the box-like cross sections illustrated of aluminum or the like.

Thus, in contrast to prior universal window frame structures, the window frame 12 is particularly strong in that it resists torsion and bending. In addition, due to the box-like cross section of the frame rails, the window structure 10 presents a particularly simple and clean appearance in installation whereby the aesthetic appearance of the window structure 10 is an improvement over prior universal window structures having a relatively busy appearance due to the cross section of the window frame extrusions used therein.

The movable window sash 14 includes a lock rail 32, guide rails 34 and 36, and a tilt rail 38, all extruded in the shapes shown of aluminum or similar material. As shown best in FIG. 1, the frame check rail 26 and sash tilt rail 38 are provided with interlocking projections 40 on the frame check rail 26 and 42 on the sash tilt rail 38 to effect a particularly tight weather seal therebeteen. In addition, an improved weather strip member 44 as illustrated particularly in FIG. 32, and which will be considered in more detail subsequently, is provided between the frame check rail 26 and sash tilt rail 38, as shown in FIG. 1.

The guiding frame rails 18 and 20, fixed rail 22, and locking frame rail 24 are connected together at the mitered corners of the frame 12 by convenient means such as screws 46. The frame adaptor members 28 and 30 are made from a single piece of extrusion cut into in the center and subsequently slid on the edge of the guiding frame rails 18 and 20, as shown, prior to connecting of the fixed frame rail 22 and frame check rail 26 to the guiding frame rails 18 and 20, after which the frame check rail 26 and then the fixed frame rail 22 are secured to the guiding frame rails 18 and 20 to lock the frame adaptor members 28 and 30 in position. Thus, close tolerance cutting of the frame adaptor members and installation of the frame check rail 26 in an exact position is not necessary with the window structure 10 illustrated in FIG. 1. This structure is also of particular advantage in that no fabrication of the guiding frame rails is required to permit installation of the frame adaptor members or frame check rail.

In a window structure 10, possible collection of water behind the weather plane must be considered and provision for weepage of such water to the exterior of the window structure 10 positioned as shown in FIG. 1, or with one of the guiding frame rails 18 or 20 positioned horizontally must be provided for. In the window structure 10 a channel 47 illustrated best in FIG. 20 is provided between the movable window sash 14 and a composite sealing strip and screen retaining member 284. Weepage occurs from between the end of the member 284 and the locking frame rail and the adjacent surface of the lock rail of the sash in the window structure 10.

With the window structure 10 positioned as shown in FIG. 1, a weepage opening is provided at each of the corners of the window structure adjacent the opposite ends of the sash lock rail. With the window structure 10 positioned as a glider window, a weep opening is provided at whichever end of the movable sash lock rail is lower. All of the weep openings so provided are shrouded by the end of the composite sealing strip and screen retaining member 284 to prevent wind passage through the window structure 10 or driving of rain through the window structure 10. Thus, the member 284 provides weepage for the window structure 10 in conjunction with the locking frame rail 24 and sash lock rail 32 as well as it provides a seal for the movable window sash 14 and retains the screen structure 304, which functions will be considered subsequently.

As shown best in FIG. 2, a plurality of window structures 10 may be positioned side by side and mulled by a single window installer through the use of a mull cover member 48 which receives the edges of one guiding frame rail 20 and the adjacent guiding frame rail 18 of two separate window structures 10. In installation, the first window structure 10 is set in place by the installer. The mull cover extrusion 48, which may be of aluminum or similarmaterial, is clipped on the guiding frame rail of the installed window structure 10, followed by the subsequent clipping of the adjacent guiding frame rail of the second window structure 10 to the mull cover and the securing of the second window structure 10 in the window opening. The camming and barb positions 50 and 52 on the mull cover 48 for receiving the guiding frame rail parts 51 and 53 together with the recesses 54 and 56 for receiving the projections 60 and 62 of the guiding frame rails permit the simple, efficient installation of the mull cover on the guiding frame rail of the first window structure and the similarly simple and efficient connection of the guiding frame rail of the second window structure to the mull cover 48.

As shown best in FIG. 3, a first modification of the mull cover 48 illustrated in FIG. 2 is executed in plastic and includes the resilient return portions 64 adjacent each of the recesses 54 and 56 oriented as shown in FIG. 3 whereby the guiding frame rail projections 60 and 62 are cammed into the recesses 54 and 56 and are subsequently locked in the recesses by the end 66 of the return portions 64 extending over the projections 60 and 62 thereof in the recesses 54 and 56. In all other respects, the modified mull cover of FIG. 3 has the same cross section as the mull cover 48.

The modification of the mull cover 48 illustrated in FIG. 3A includes extended camming and barb portions 55 and 57 which diverge from each other and the portions 59 and 61 which are slanted toward each other as shown. In installation the modified mull cover illustrated in FIG. 3A is snapped in place over two adjacent guiding frame rails 18 and 20 which have previously been secured adjacent each other in the position illustrated in FIG. 2. The portions 55 and 57 of the mull cover illustrated in FIG. 3A are cammed over the portions 51 and 53 of the adjacent guiding frame rails and the portions 59 and 61 are cammed over the portions 60 and 62 of the guiding frame rails. One man can easily install mulled windows using the mull cover of FIG. 3A since the mulling of the windows is accomplished with the windows in place of contrast to prior procedures wherein windows have been mulled before installation thereof and a number of men have been required to install the premulled windows.

The window structure 10 may be glazed in a plurality of different manners, as shown particularly in FIG. 4, wherein in the present window structure 10 illustrated in FIG. 1, the fixed glazing panel 16 is a single pane of glass held in position by applicant's unique glazing strip 68 in the inner glazing groove 80. Glazing strip 68 is disclosed in more detail in application Ser. No. 36,303, referred to above and permits the installation of both single and double pane glazing panels of different thicknesses in the window structure 10 with a single glazing strip.

In addition, a storm window including a glazing panel 70 and edge strip 72 may be installed over the glazing panel 16 by means of installation clips 74 to provide storm window protection for the fixed glazing panel of the window structure 10, as shown in more detail in application Ser. No. 38,453, referred to above.

In contrast, the movable window sash 14 is glazed with thermal glass 76 having a double thickness with the same glazing strip 68 placed in the outer glazing groove 78 rather than the inner glazing groove 80. In addition to the two glazing grooves 78 and 80, it will be understood that due to the shape of the glazing strip 68, it may be flexed to accommodate single or double-pane glazing material of different thickness whereby the one glazing strip is universal for substantially all normal glazing panel thicknesses.

Again, as shown best in FIG. 4, the frame adaptor extrusions 28 and 30 are provided with a beveled surface 82, while the movable sash guide rails 34 and 36 are provided with a complementary beveled surface 84 positioned to be in spaced relation to the beveled surface 82. Thus, on movement of the movable sash 14, particularly when the window structure 10 is used as a glider window, no metal-to-metal contact is present so that galling of the metal surfaces and noisy operation of the window structure 10 is eliminated. Care has also been taken in all other areas of the window construction where movement exists to prevent metal-to-metal surface engagement and facilitate the overall quiet operation of the window structure 10.

In addition, the movable portions of the window structure 10 such as the movable sash 14 are positively spaced from adjacent metal members such as the frame 12 by, for example, such structure as the tilt release and guide structure 90 and the sash guide and pivot structure 92 so that the movable sash 14 floats in the frame 12. Thus, overall quiet operation of the window structure 10 is again facilitated and metal-to-metal surface engagement and therefore galling of the members of the window structure 10 is prevented.

The movable sash guide rails 34 and 36, tilt rail 38 and lock rail 32 are secured together by convenient means such as screws 86 and 88 which are also used to install the sash guide and tilt release structure 90 and the sash guide and pivot structure 92, respectively.

False window mullion structure 96 including false window mullion members 98, connecting members 100, and installation brackets therefor 102, as disclosed in more detail in application Ser. No. 7,452, referenced above, may be provided in conjunction with the window structure 10 and are shown in FIG. 1. Window structure 10 also includes the known sash balance structure 104 adapted to be secured within the pocket 106 in guiding frame rail 20 by means of screw 108 or the like.

A hopper lock 110 again as considered in more detail in application Ser. No. 36,303, referenced above, may be used in conjunction with the window structure 10, and is shown in FIG. 1. The hopper lock 110 is engaged at end 112 in pocket 114 in sash guide rail 36 and is engaged at end 114 in pocket 106 of guiding frame rail 20 in the window structure 10 and limits pivotal movement of the movable sash 14 about the lock rail thereof in accordance with the position of the hopper lock 110 in the guiding frame rail 20 and the position of the movable sash 14 when it is tilted.

In more detail, the improved sash guide and tilt release structure 90, as shown best in FIGS. 5–7, includes a separate sash guide member 118, a separate tilt release member 120 and biasing spring 122. As shown best in FIGS. 5 and 6, the sash guide member 118 is secured in the pocket 114 in the sash guide rail 36 by means of the assembly screw 86 for the movable sash 14.

In assembly, the spaced apart flanges 124 space the sash guide rail 36 from the guiding frame rail 20. The flanges 124 on the sash guide member 118 are beveled at 126 as a continuation of bevel 84 on guide rail 36 to provide clearance between the sash guide member 118 and the frame adaptor members 28 and 30 on opposite sides of the frame 12 with the member 118 used on either side of the frame 12. The flanges 124 are provided with a further bevel 128 to provide clearance for the sash balance 104 in assembly. The flanges 124 further include the hook-like ends 130 thereon which define a pivot notch 132 into which the tilt release member 120 of the sash guide and tilt release structure is positioned in assembly, as will be seen best in FIG. 6.

The head portion 136 of the sash guide member 118 fits within the slot 138 in the tilt release member to guide the tilt release member on pivoting thereof about the pivot portion 134 thereof. Head portion 136 has the camming abutment 140 thereon which permits camming of the head portion into the slot 138 and which abuts the handle portion 142 of the tilt release member 120 in assembly to prevent disassembly of the sash guide and tilt release structure 90 except on upward bending of the handle 142.

The tilt release member 120 as shown best in FIG. 7 includes the handle portion 142 having the slot 138 therein for receiving and guiding the head 136 of the sash guide member 118, which slot is maintained in relatively close tolerance by means of a spacing strap 144 placed across the open end thereof above the opening 146 in the tilt release member 120 through which the head of the screw 86 extends for ease in assembly. The tilt release member 120 further includes the flanges 148 thereon extending beyond the end 150 of the handle 142 so that in assembly the flanges 148 extend within the pocket 106 in a frame jamb member to prevent tilting of the movable sash 14 except on pivoting of the tilt release member 120 about pivot portion 134 thereof to compress spring 122 and remove flanges 148 from the pocket 106. The end 150 of the handle 142 abuts the edges of the pocket 106 in jamb 20 to prevent entry of the handle 142 into the pocket 106 and thus limits entry of the flanges 148 into the pocket 106 in assembly so that contact of flanges 148 with the sash balance 104 on movement of the sash 14 is prevented.

The recess 152 is provided in the tilt release member 120 and in conjunction with a similar recess in the sash guide 118 locates the ends of the spring 122 between the sash guide member 118 and the tilt release member 120 in assembly. The toe portion 154 of the tilt release member 120 is adapted to steady the member 120 on vertical movement of the movable sash 14, while the heel portion 156 of the tilt release member 120 engages the guide rail of the sash 14 within the pocket 114 to limit the pivotal movement of the member 120 under bias of the spring 122 in assembly.

In use the sash guide and tilt release structure 90 is first assembled by placing the pivot portion 134 of the tilt release member 120 in the notch 132 and positioning one end of the spring 122 in the recess 152 with the other end of the spring 122 in a guide therefor in the sash guide member 118. The spring is then compressed by pivoting the tilt release member 120 about the pivot portion 134 thereof to cam the head 136 of the sash guide member 118 into the slot 138 in the tilt release member 120. So assembled, the sash guide and tilt release structure 90 is secured in the sash guide rail pocket 114 at the tilt rail of the movable sash 14 by means of the screw 86.

The handle 142 of the tilt release member 120 is then moved toward the sash guide member 118 to compress the spring 122 and the movable sash 14 which has been in a tilted position in the frame 12 is tilted into the plane of the frame 12 of the window structure 12. The tilt release member 120 is then released so that the spring 122 moves the flanges 148 into the pocket 106 in the guiding frame rail 20 as shown in FIGS. 5 and 6 and the end 150 of the handle 142 abuts the guiding frame rail 20 at the entrance to the pocket 106 to limit insertion of the tilt release member 120 into the pocket 106 under bias of the spring 122. The movement of the sash 14 in the frame 12 is then guided by the flanges 148 on the tilt release member 120, and the sash 14 and frame 12 are spaced by the flanges 124 on the sash guide member 118. When it is desired to again tilt the movable sash 14 into the hopper position, the handle 142 is grasped and moved toward the movable sash 14 to remove the guide flanges 148 from the pocket 106 of the guiding frame rail, and the movable sash 14 may be tilted.

In the above consideration of the sash guide and tilt release structure 90, it will be understood that one such structure may be provided at each end of the tilt rail of the movable sash 14.

The movable sash 14 is also guided by the sash guide and pivot structure 92 as indicated above, which is shown best in FIGS. 8–11. As shown in FIG. 11, the sash guide and pivot structure 92 includes the sash guide and pivot member 160 and the spring 162.

The sash guide and pivot member 160 includes the pivot portion 164 which as shown is beveled at the outer end thereof for insertion in the pocket 106 in the guiding frame rail 20. Pivot portion 164 provides a pivot axis at the ends of the lock rail of the movable window sash 14 for tilting the sash 14 into a hopper position. The sash guide and pivot member 160 further includes the rectangular portion 166 separated from the pivot portion 164 by the flange 168, which flange also extends beneath the rectangular portion 166 thereof as shown in FIG. 11.

In assembly, the rectangular portion 166 is positioned within the pocket 114 in the lock rail 36 of the movable sash 14 with the flange 168 extending over the exterior edge of the lock rail and over the end of the lock rail to provide a finished corner for the movable sash 14 so that the sealing strip for the movable sash 14 will not be damaged on movement of the movable sash as, for example, into and out of a tilted position. The sash guide and pivot member is secured to the end of the sash guide rail 36 and to the lock rail 32 by means of the screw 88 illustrated in FIG. 1 extending through the opening 170 in the sash guide and pivot member.

The sash guide and pivot member 160 further includes the extension 172 having the spring guide 174 thereon and which includes a guide portion 176 on one side of the end thereof and a barb portion 178 on the other side of the end thereof. The end of the extension 172 is further provided with beveled surfaces 180 and 182 at both sides of the barb and is provided with feather edges 184 and 186 as shown best in FIG. 11, all of which facilitate pivotal movement of sash 14 into and out of the plane of the window structure 10.

In assembly the sash guide and pivot member 92 with spring 162 on guide 174 is secured to an end of the sash guide rails at an end of the lock rail as shown in FIG. 9 by means of a screw extending through opening 170. The guide portion 176 assumes a normal operating position within the pocket 114 of the sash guide rail 36 of the sash 14 on installation. On pivoting of the sash 14 into the plane of the window frame 12 from the tilted position thereof in which the pivot portions 164 of member 160 are inserted in pockets 106, the extension 172 is cammed into the desired position thereof by the cam surface 180 on the extension 172. In the plane of frame 12, the extension 172 is prevented from entering the recess 106 in the guiding frame rail 20 and is guided into movement into and out of the plane of the frame 12 not only by the beveled edge 180but by the beveled edge 182 and the feathered edges 186 and 184 as indicated above.

The sash guide and pivot member 160 is useable without the sash balance shoe 188 in a glider window installation or on a nonbalanced side of a single-hung window installation with the spring 162 removed. Removal of spring 162 deactivates portion 172 of member 160.

In addition, it will be understood that the extension 172 of member 160 could be a separate member pivoted to the pivot portion and rectangular portion separated by the flange 168 as for example in the sash guide and tilt release structure 90.

The barb 178 on extension 172 is operable in conjunction with the sash balance shoe 188 illustrated best in FIG. 10 to secure the sash balance 104 which is in the pocket 106 to the movable sash 14 through the sash guide and pivot member 160.

The sash balance shoe 188 as shown best in FIGS. 9 and 10 includes the recess 190 in the rear thereof and the recess 192 in the front thereof, which recesses are connected by a transverse slot 194 extending therebetween. Thus, the end of the torsion ribbon 196 of the sash balance 104 is readily secured to and released from the sash balance shoe 188 on moving the end thereof which includes the offset portion 198 through the slot 194, all as considered in more detail in application Ser. No. 36,303 referenced above.

The sash balance shoe includes the surfaces 200 and 202 thereon shown best in FIG. 10 which are engageable with the internal surface of the pocket 106 at one side of the entrance thereof and with the external surface at the entrance of the pocket 106 on the other side thereof as shown best in FIG. 8 in assembly. The surfaces 200 and 202 locate the sash balance shoe in the pocket 106 when it is connected to the torsion ribbon 196. Torsion ribbon 196 is constructed to provide only counterclockwise torsion on the sash balance shoe 188 as illustrated in FIG. 8. Torsioning of the sash balance in the wrong direction is thus not possible with the sash balance shoe 188, since it would not be possible to install the sash balance shoe 188 in the recess 106 if the sash balance shoe were torsioned in the wrong direction.

The bevel surface 204 on one side of the sash balance shoe provides clearance for assmbly screws. The arcuate surface 206 on the other side of the sash balance shoe 188 permits easy rotating of the sash balance shoe 188 installed on the torsion ribbon 196 into the pocket 106 in the guiding frame rail 20 and removal thereof from the pocket 106.

In operation, with the sash balance shoe attached to the sash balance 104 within the pocket 106, the sash balance shoe 188 will be moved to the upper limit thereof allowed by the sash balance 104. The movable sash 14 may then be inserted in the window opening therefor between the guiding frame rails 18 and 20 with the pivot portions of the sash guide and pivot member 160 in the pockets 106 which will require canting of the lock rail of the movable window member 14 from a position wherein the movable window is in a substantially horizontal plane to a position in which the movable window slants toward one guiding frame rail or the other and subsequent movement of the movable window into a horizontal plane after the pivot portions 164 of the sash guide and pivot members 160 at each side thereof have been positioned in the respective pockets 106 in the guiding frame rails 18 and 20.

The movable window 14 is then pivoted into a closed position with the extension 172 of the sash guide and pivot member 160 being cammed past the guiding frame rails 18 and 20 to place the movable window sash 14 in the plane of the frame 12 position. The movable window sash is then moved toward the fixed frame rail as far as possible at which time the lower beveled edge 208 on the sash balance shoe 188 will cam past the barb 178 on the extension 172, and the barb 172 will snap over the upper edge 210 of the sash balance shoe 188. Subsequently, when the movable sash 14 is moved toward the locking frame rail, the sash balance shoe 188 will be secured to the sash guide and pivot member 160 for movement therewith to provide a counterbalance for the movable window sash 14 in use as a single-hung window.

On subsequent pivoting of the movable window sash 14 past approximately 30°, the sash balance shoe member 188 is released by the barb 178 on the extension 172 of the sash guide and pivot structure and will return toward the fixed frame rail to a limiting position thereof to be reengaged on subsequent tilting of the sash back into the plane of frame 12 and movement toward the fixed frame rail. The sash balance shoe 188 is not released on tilting of the movable sash 14 less than approximately 30° to permit ventilation. With such operation, it will be readily seen that it is not necessary with the sash guide and pivot structure and the particular sash balance shoe associated therewith disclosed herein to exactly locate the pivot portions 164 of the sash guide and pivot member on installation of the movable sash 14 after it has been removed to insure engagement of a sash balance shoe which has been maintained in the position it held on removal of the movable window sash.

The modified sash guide and pivot member 212 illustrated in FIG. 12 is intended for use by itself without a sash balance or with either of the sash balance shoes 214 and 216 illustrated in FIGS. 13 and 14.

The sash guide and pivot member 212 includes the pivot portion 218 and a rectangular portion 220 separated by the flange 222 which as shown extends around the bottom of the rectangular portion 220. As with the sash guide and pivot member 160 illustrated in FIGs. 8–11, the sash guide pivot member 212 is secured to the end of a movable sash guide rail at the end of the sash lock rail in the pocket 114 by an assembly screw extending through the opening 224.

Also as before, the pivot portion 218 is slightly larger in the direction of movement of the movable sash 14 in the plane of the frame 10 than it is transverse to the plane of the frame 10 with the movable sash 14 in a non-tilted position and the sash guide and pivot member 212 installed thereon whereby on pivoting of the sash 14 out of the plane of the window frame into the hopper position, the bottom edge of the movable sash 14 is locked in a predetermined position in the frame 12 by wedging the pivot portion 218 between the opposite surfaces at the opening of the pocket 106.

The sash balance shoe 214 is similar to the sash balance shoe 188 in the upper portion 226 as shown. However, an extension 228 is provided on the bottom thereof which includes an elongated opening 230 therethrough for receiving the pivot portion 218 of the sash guide and pivot member 212. Thus, with the sash guide and pivot member 212 used in conjunction with the sash balance shoe 214, the pivot portion 218 must be exactly located on reinstalling a removed movable window sash 14 to position the pivot portion 218 in the opening 230.

Similarly, the sash balance shoe 216 may be used with the sash guide and pivot member 212, and again receives the offset end 198 of the sash balance ribbon 196 in the same manner as the sash balance shoes 188 and 214, as particularly shown in FIG. 9. However, in place of the opening 230 in the lower extension 228 shown on the sash balance shoe 214, the opening 234 in the sash balance shoe 216 is open at the lower end and has hook portions 236 at the open end thereof with arcuate lower camming surfaces 238. Thus, with the sash balance shoe 216 a sash 14 may be replaced in the window frame 12 in any position along the guiding frame rails and when moved toward the fixed frame rail will spread the lower portion of the sash balance shoe 216 apart with the pivot portion 218 of the sash guide and pivot member 212 whereby the pivot portion 218 is received in the opening 234 and the sash balance shoe 216 is locked to the movable window sash 14 until such time as the movable window sash 14 is again removed from the frame 12.

With the movable sash 14 in the position in the window structure 10 shown in FIG. 1, the lock rail of the movable window sash 14 is automatically locked to the locking frame rail 24 of the window frame 12 by the lock structure 240. Lock structure 240 includes the lock body member 242 and the lock actuating member 244 together with the lock spring 246, illustrated best in FIG. 17.

Lock body member 242 includes an end elevation and transverse cross section which allows it to be slidably received in the longitudinally extending recess 248 in the lock rail 32 of the movable sash 14, as shown best in FIG. 16. In addition, the lock body member 242 includes the slot 250 therein for receiving a locking frame rail cross section part 252 having the barb 254 thereon with the movable sash 14 in a fully closed position. Slot 250 serves to align the lock structure 240 with the locking frame rail 24 of the window frame 12.

An opening 256 is provided through the lock body member 242 to receive the lock actuating member 244 and is provided with recesses 258 in the opposite ends thereof for receiving the pivot portions 260 of the lock actuating member 244. The lock body member 242 is further provided with a cylindrical portion 262 including a recess 268 therein for receiving the spring 246 in assembly.

The lock actuating member 244 includes the locking part 263 having barb 264 thereon engageable with the locking barb 254 on the locking frame rail extension 252 in operation to lock the movable window sash 14 in a closed position. Lock actuating member 244 is further provided with a centrally located projection 266, shown best in FIG. 16, adapted to extend within the recess 268 in the cylinder 262 beneath the spring 246 in assembly. The handle portion 270 on the lock actuating member 244 is movable to pivot the lock actuating member 244 about the pivot means 260 thereof in opposition to the bias of the spring 246 which is in engagement at the opposite ends thereof with projection 266 of the member 244 and the top of the pocket 248 in the sash lock rail 32 in assembly to pivot the locking barb 246 out of engagement with the locking barb 254 on the locking frame rail extension 252 and permit movement of the window sash 14 as desired. The lock structure is automatically reengaged on closing of the movable window sash 14 fully to cam the locking barb 214 over the locking barb 254.

It will be particularly noted that the locking structure 240 permits movement of the locking structure 240 anywhere within the recess 248 in the sash lock rail 32 so that with the window in use as a glider window, the lock structure 240 may be lowered for use by shorter people or may be raised to prevent use thereof by children, as desired.

Even with the sash guide and tilt release structure 90 and the sash guide and pivot structure 92 engaged with the frame jambs 18 and 20 and with the lock structure 240 secured, during very high winds the movable sash guide rails 34 and 36 which are not inserted in the usual guide channels to permit tilting of the sash may bend sufficiently to break the seal between the guiding frame rails and movable sash guide rails without additional support of the sash guide rails by guiding the frame rails. Accordingly, the bracket structure 272 may be provided in conjunction with sash having a large vertical dimension in areas where extremely high winds may occasionally be expected.

The bracket structure 272 includes brackets 274 and 276 secured at right angles to each other on, for example, the sash guide rail 36 and the guiding frame rail 20 by means of screws or the like (not shown). The brackets which are identical include the rectangular spacing portion 278 having the screw opening 282 extending therethrough and the locking portion 280 as shown in the perspective view of the bracket 276 illustrated in FIG. 19.

With a pair of brackets 274 and 276 installed at both sides of the movable window sash 14, as shown in FIG. 18, the sash guide rails 34 and 36 are locked to the guiding frame rails 18 and 20 until the movable sash 14 is raised approximately a half inch to remove the locking portion of the bracket 274 on the sash guide rail 36 from the pocket formed by the locking portion of the bracket 276 in conjunction with the guiding frame rail 20. No special knowledge or instructions are necessary to permit operation of bracket structure 272.

The bracket structure 272 provides the additional support of the guiding frame rails 18 and 20 which are comparatively very strong to the sash guide rails 34 and 36, with the movable jamb 14 in a locked position. By placing the brackets 274 and 276, which are very inexpensive, in the center of the sash guide rails an increase in sash guide rail strength of 800 percent is possible.

A seal is provided between the sash guide rails 34 and 36 of the movable sash 14 and the guiding frame rails 18 and 20 by the composite sealing strip and screen retaining member 284 shown in installation on the guiding frame rail 20 and in conjunction with the sash guide rail 36 in FIG. 20. As shown, the composite sealing strip and screen retaining member 284 includes a relatively rigid L-shaped cross section portion 290 having hook parts 292 and 294 on one leg thereof which engage the grooves 296 and 298 extending longitudinally in the guiding frame rail 20 and the camming part 300 and locking lip 302 for retaining the screen structure 304 on the other leg thereof. A relatively soft sealing strip portion 306 is extruded simultaneously with the L-shaped portion 290 of the composite member and is adapted to extend over the sash guide rails 36 with the composite member 290 secured to the guiding frame rail 20 as shown in FIG. 20 to provide a seal therebetween which is increased by wind pressure on the exterior of the window structure 10 until the sash guide rails 34 and 36 deflect sufficiently to require the bracket structure 272. The composite sealing strip and screen retaining member 284 thus eliminates the need for separate screen retaining clips.

In installation, the composite sealing strip and screen retaining member 284, as shown in perspective in FIG. 21, is snapped onto a guiding frame rail such as rail 20 and extends substantially the entire length of the movable sash 14 in a closed position over the guide rail 36 thereof as shown in FIG. 20. Screen structure 304 is then inserted behind the retaining lip 308 on the frame check rail 38 as shown best in FIG. 1, and the screen is cammed into the screen retaining portion of the L-shaped portion of the composite member 284 over the camming part 300 until it snaps behind the locking lip 302, after which the screen is lowered to be received behind the screen retaining lip 310 illustrated in FIG. 1 on the locking frame rail 24.

The composite sealing strip and screen retaining member 284 provides a superior bug seal. Thus, even though a screen frame member may be bowed, the L-shaped portion 290 of the member 284 prevents bugs from getting between the window frame 12 and screen structure 304 with the screen structure behind the locking lip 302. In addition, the L-shaped portion 290 of the member 284 provides a wind screen so that wind does not get behind the screens and build up pressure which has in the past resulted in screens popping out of window structures of, for example, moving mobile homes.

Window structure 10 may be installed in a window opening 312 from the inside thereof by use of installation clips 314, illustrated best in FIG. 24. Installation clip 314 includes the U-shaped portion 316 having the connecting part 318 and the leg parts 320 and 322. A spacing portion 324 is provided extending from the connecting portion 316 of the clip 314, as shown in FIG. 24. The nailing strip 326 and the resilient retaining portion 328 having the retaining lip 330 thereon are connected to an extension 332 of the connecting portion 316 of the cross section of the clip 314, all as shown best in FIG. 24.

Installation clips 314 are installed in the guiding frame rails 18 and 20, fixed frame rail 22 and locking frame rail 24, as shown for example in FIG. 22, by inserting the leg portions 320 and 322 thereof in the pocket 334 in, for example, the locking frame rail 24 illustrated in FIG. 22 until the locking lip 320 cams over the portion 336 of the rail 24. The window structure 10 with the installation clips 314 assembled therewith is then positioned in the window opening 312 until the spacing portion 324 abuts the wood buck 338 defining the window opening 312, and the clips 314 are nailed to the wood buck 338 by driving a nail through the nailing strip 326 of the clip 314 which may be accomplished from the inside of the window opening 312. The window opening 312 may then be finished by securing the trim members 340 around the opening 312 as shown and as more fully described in application Ser. No. 36,303, referenced above.

If it is subsequently desired to remove the window structure 10 from the window opening 312, removal may be accomplished by first depressing the resilient retaining portion 328 of the installation clips 314 by means of a screwdriver positioned on the end thereof to provide clearance between the retaining lip 330 and the locking frame rail 24 and similar members having installation clips 314 secured thereto. Window structures 10 may then be reinstalled by merely moving them into the opening again over the installed clips to place the leg portions of the clips in pockets 334 and to move the locking lip 330 over the part 336 of the frame rail. Installation of and removal and replacing of window structures 10 in multistoried construction is thus greatly facilitated, since all such work may be accomplished from inside the building structure.

Wherein it is desired to use wood trim members 342, the nailing portions 326 of the installation clips 314 may be deformed prior to or at the time of nailing thereof to bucks 338 about the opening 312 to permit the placing of the wood trim members 342 over the top thereof and between the nailing portion 326 and the retaining portion 328 of the installation clips 314 as illustrated in FIG. 23.

In an alternate construction illustrated in FIG. 25, clips 315 include the U-shaped portion 317 having a generally V-shaped connecting part 319 to permit easy insertion of the clip 315 within the pocket 334 in for example the frame rail 24. The spacing part 321 is secured to the leg 323 of the U-shaped portion 317 by means of an offsetting part 325. The nailing strip 327 and resilient retaining portion 329 are secured to an offsetting portion 331 extending from the end of the other leg 333 of the U-shaped portion 317 of the clip 315.

The installation and use of the clip 315 is substantially the same as the installation and use of the clip 314. The V-shaped connecting part 319 of the U-shaped portion 317 of the clip permits easy insertion of the clip into the pocket 334. Also the clip 315 has been made nonreleasable once it is inserted in a window frame so that the resilient portion 329 of the clip 315 is terminated at the lip 335 whereby in installation there will be no part of the retaining portion 329 extending beyond the part 336 of frame rail 24 in installation so that depression of the resilient portion once the clip 315 is installed is difficult or impossible. The clips 314 can of course be provided with the resilient portion 328 terminated at the lip 330 if it is not desired to separate the clips from the window frame.

In a further alternate construction as illustrated in FIG. 25, an installation clip 343 constructed from sheet metal is used to install the window structure 10 in a window opening 344 from the inside of the window opening. As shown in FIG. 26, the clip 343 includes the leg portions 346 offset at 348 and again at 350 to provide integral nailing portions 354 for securing the clips 343 to the wood buck 352. The leg portions 346 are connected by the connecting portion 356. The resilient locking portion 358 of the installation clip 343, as shown, is a portion cut out of the sheet metal clip between the leg portions thereof which is connected-thereto at the connecting portion of the clip 356 which locking portion 358 is inclined with respect to the leg portions of the bracket and is provided with an offset central portion 360 and an L-shaped terminal portion 362. Alternatively, nailing openings may be provided in flat ends of the leg portions 346 of the clip 343 in place of the integral nailing portions 354 and offsets 350.

As shown in FIG. 25, clips 343 are installed on wood buck 352, for example. The window structure 10 is then inserted in the window opening 344 and the clips 343 are placed in the pockets 344, after which suitable trim 364 is applied around the interior of the window opening 344. This in in contrast to clips 314 which are placed in pockets 344 and are subsequently nailed to the wood buck. Again, if it is desired to remove the window structure 10, the clips may be compressed by means of a screwdriver placed on the part 366 of the L-shaped terminal portion 362 of the central portion 360 of the clips.

The modified installation clip 368 illustrated in FIG. 27 is substantially the same in operation as the clip 343 but is formed of spring wire including integral nailing portions 370 on the ends thereof and an L-shaped locking portion 372. The use of the clip 368 and the position thereof in assembly is substantially the same as the use of the clip 343 and the position of the clip 343 in assembly.

As shown best in FIGS. 28 and 29, the window structure 10 as illustrated by the frame sill memnber 24 may also be installed from the exterior of different window openings 374 and 376 in conjunction with the installation bracket 378 illustrated best in FIG. 30. As shown, the installation bracket 378 has a T-shaped cross section with a screw runner channel 380 extending the length thereof at the intersection of the stem and crossbar of the T-shaped cross section. Bracket 378 has notches 382 and 384 at the ends thereof constructed to provide room for sealing strips 384 on the part 386 of the cross section of jamb 24, as shown best in FIG. 31. Notches 382 and 384 are desirable but not essential.

In installation of a window structure 10 from the exterior of the window opening 374 in conjunction with the installation brackets 378, the brackets are inserted in the pockets 334 at required positions around the window frame 12. The screws 390 are passed through prepared openings in the window frame 12 and through the screw runners 380. The window structure 10 is then positioned in the window opening 374 and the screws 390 are driven into the wood bucks 392 defining the window opening 374. Subsequently the extruded plastic trim members 374 are placed in position in the window opening 374 from the interior thereof. When it is desired to remove the window structure 10 from the opening 374, it is merely necessary to remove the screws 390 and subsequently remove the window structure 10.

The installation of the window structure 10 illustrated in FIG. 29 illustrates the versatility of the installation bracket 378 with different building structures and is shown in conjunction with an elongated plastic trim member 410 for use in providing an installed, trimmed window in solid masonry construction.

As shown best in FIG. 31, the weather seal 384 includes a generally H-shaped cross section having a cross-bar 396 and the shorter sealing leg 398 and the longer sealing leg 400 which engage the surface of the building construction surrounding the window opening 374, as shown in FIG. 29. The sealing strip 384 further includes the leg 402 extending along the bottom of the part 386 of the window frame sill 24 and the leg 404 having the locking rib 406 thereon which extends into a recess 408 extending longitudinally in the part 386 of the locking frame rail 24 to secure the sealing strip 396 to the rail. The sealing strips 384 have been found to provide a more reliable and less messy weather strip which is easy to install in conjunction with the window frame 12 than the usual caulking.

The modified weather seal 385 illustrated in FIG. 32 is exactly the same as weather seal 384 with the exception of the leg 387 which in the modified weather seal 385 has a portion 389 extending parallel to and away from the crossbar 391 and has a returned portion 393 shaped as shown in FIG. 32. The portion 389 provides more flexibility in the leg 387 and the returned portion 393 permits movement of the window frame in the direction of extent of portion 389 of leg 387 without damage to the seal provided by strip 385.

In the further modified weather seal 395 illustrated in section in FIG. 34, the crossbar 397 and the legs 399 and 401 of the generally H-shaped cross section are the same as the corresponding portions of the weather seals 384 and 385. The leg portions 403 and 405 are, however, thinner than the leg portions 398 and 400 of the weather seal 384 and are more arcuate than the leg portion 387 of the weather seal 385. Thus, in installation the legs 403 and 405 may be more readily flexed to provide a continuous weather seal and the window may be moved in the direction of extent of either leg 403 or 405 from the crossbar 397 without breaking the weather seal due to deforming the legs 403 or 405.

The sealing strip 44 between the sash lock rail 32 and the locking frame rail 24, as shown best in FIG. 33, has a generally Y-shaped cross section including a shorter, thicker leg 412 which is more resistant to bending than the longer, thinner leg 414. This configuration for the sealing strip 44 permits ready installation of the sealing strip in the dovetail recess 416, inhibits removal of the strip in the recess in operation and facilitates deforming of the sealing portion 418 of the Y-shaped cross section 44 to provide a seal in operation. Such sealing members have been found to be easier to install by rotating the sealing members into position in the recesses 416 on flexing of the thinner leg 414 and to be more efficient particularly between the sash lock rail 32 and locking frame rail 24 and at the frame check rail 26 and sash tilt rail 38 than the usual felt weather stripping at these points.

The improved window glazing structure 440 illustrated in assembly in FIG. 36 comprises a retaining member 442 and a stuffer member 444. As shown, the retaining member 442 is an elongated strip with an L-shaped cross section having a foot portion 446 which is adapted to fit within the recesses 78 or 80 in the window sash guide rail 36. The stem portion 448 of the retaining member 442 which is connected at an angle slightly greater than 90° to the foot portion 446, as illustrated, is terminated in the portion 450 extending substantially perpendicular to the window pane 76. The stuffer member is also an elongated strip provided with a cross section as shown in FIG. 36 and includes the recess 452 into which the terminal portion 450 of the retaining member 442 extends in assembly and barbs 454 and 456 engaged with the window pane 76 in assembly.

With the structure 440, when it is desired to glaze a window sash 14, the window pane 76 or other closure panel is positioned as shown in FIG. 36. The retaining member 442 is positioned with the foot portion 446 thereof in the recess 480 and the stuffer member 444 is then wedged between the retaining member 442 and the window pane 76 with the barbs 454 and 456 in sealing engagement with the window pane 76 until the end 450 of the retaining member 442 snaps within the recess 452 in the stuffer member 444. A tight glazing seal may thus be provided extending completely around the window pane 76.

The stuffer member 444 is used in conjunction with a second similar stuffer member 458 illustrated in section in FIG. 37 with a single retaining member 442 to glaze window rails such as sash rail 14 with glass panes or panels having different thicknesses. The stuffer member 458 is similar to the stuffer member 444 but includes the elongated barbs 460 and 462 thereon. Barb 462 extends from the end 464 of the stuffer member 458 rather than the center thereof as in the case of stuffer member 444. Thus, the stuffer member 458 will be used to glaze panels of lesser thickness, while the stuffer members 444 will be used to glaze panels of relative greater thickness with the retaining member 442 in either of the panels 78 and 80. Since both of the stuffer members 444 and 458 may be used to glaze a plurality of sizes of panels in themseleves due to the flexibility of the retaining member 442 and the barbs 454, 456, 460 and 462, the entire range of normal glazing panels may be glaze with the three members 442, 444 and 458, which are particularly simple to install and which are capable of being removed on stripping of the stuffer members from the retaining member 442, if desired.

The trim member 468 shown in section in FIG. 38 is an elongated L-shaped strip having a foot part 470 terminated at one end in a portion 472 extending in the same direction as the stem part 474 of the L-shaped strip. As shown, the strip 468 is adapted to receive an edge of the dry wall structure 466 in assembly and is spaced therefrom by the terminal portion 472. An extension 476 of the foot part 468 engages one end of the lip portion 471, extending around frame 12. An open returned portion 478 depends from the end of the stem part 474 of the strip 468 to close the joint between the strip 468 on the portion 471 of the frame 12.

When the window structure 10 is installed in conjunction with dry wall material 466, as shown in FIG. 38, a trim member 468 is provided to extend over the frame portion 470 to finish the edge of the dry wall material. As shown, in installing the window frame 10 illustrated by the guiding frame rail 18 in FIG. 38 in a window opening 472 defined by wood studs 474, the window frame 12 is positioned in the window opening in the usual manner, the trim member 468 is applied to the portion 470 of the guiding frame rail 18 and the dry wall material 466 is subsequently positioned as shown in FIG. 38 to complete a trimmed window installation.

The modified trim member 482 illustrated in FIG. 39 has a cross section exactly the same as the cross section of the trim member 468 and in addition the cross section of the trim member 482 includes the second L-shaped portion 484 having the stem part 486 which is a continuation of the stem part 474 of the L-shaped trim member 468 and the foot part 488 extending at an angle of less than 90° to the part 486, as shown in FIG. 39. The part 488 of the trim member 482 is adapted to fit between the dry wall structure 466 and the wall stud 474 so that in assembly the terminal portion 472 is biased into engagement with the dry wall structure trimmed thereby which has a thickness such that in assembly the foot part 488 of the second L-shaped portion 484 of the trim member 482 is forced into a substantially perpendicular position with respect to the stem part 486 of the portion 484. The installation of the trim member 482 on the window structure 10 is the same as the installation of the trim member 468.

In the further modified trim member 490 illustrated in FIG. 40, the extension 476 included on trim members 468 and 482 is removed from the first L-shaped portion 492 of the trim member 490 and extension 494 is placed thereon to space the trim member 490 from the end of the dry wall structure 466 in assembly in the same manner as the terminal portion 472 spaces the trim member 468 from the dry wall structure 466. The open returned portion 496 of the trim member 490 which forms recess 502 further has secured to the end thereof the L-shaped portion 498, the foot part 500 of which is again adapted to fit between the dry wall structure 466 and the stud 474 in assembly. Thus, with the edge of the frame lip 471 in the recess 502 in the trim member 490 in installation, the L-shaped portion 492 is urged into engagement with the window frame to provide a tight joint therebetween and the snap-in installation of the window frame 12. The aesthetic installation of the window frame 12 with the dry wall member 466 is thus facilitated.

While one embodiment of the present invention has been considered in detail, it will be understood that other embodiments and modifications are contemplated by the inventor. It is the intention to include all modifications and embodiments in the disclosure as are defined by the appended claims within the scope of the invention.

What I claim as my invention is:

1. Window structure for installation both as a single-hung window or as a hopper window and as a right or left hand glider window including a frame having a fixed frame rail, guiding frame rails, a locking frame rail and a frame check rail, at least one movable sash secured within the frame for selective movement in the plane of the window frame and tilting out of the plane of the window frame about one edge of the sash including a tilt rail, guide rails having longitudinal recesses therein and a lock rail, and sash guide and pivot structure positioned at least partly within the longitudinal recesses of the sash guide rails and secured to opposite corners of the movable sash, spacing the movable sash from the frame rails, finishing the ends of the movable sash guide rails at the ends of the sash lock rail to prevent damage to weather stripping on pivoting of the movable sash about the lock rail thereof and providing a pivot axis for the movable sash on pivoting thereof, which sash guide and pivot structure is operable to lock the movable sash in a pivoted position with respect to movement of the movable sash along the frame, which sash guide and pivot structure includes a rectangular portion adapted to fit within the movable sash guide rail at the end thereof adjacent an end of the sash lock rail, an L-shaped flange extending over perpendicular sides of the rectangular portion for engaging the side and one end of the guide rail of the movable sash and an elongated pivot portion extending on the opposite side of the flange from the rectangular portion of the sash guide and pivot structure and away from the sash guide rail and into the guiding frame rail in installation on a movable sash installed in the window structure and having a larger dimension in the plane of the window structure than transversely of the window structure whereby on tilting of the movable window sash the pivot portion of the sash guide and pivot member extending within the guiding frame rail engages portions of the rail to lock the movable sash in the frame with respect to movement of the sash along the frame.

2. Structure as set forth in claim 1 and further including a flexible extension secured to the sash guide and pivot member, and extending toward the tilt rail of the sash with the sash guide and pivot member in installation which extension includes a sash balance shoe retaining barb on the end thereof projecting in the same direction as the pivot portion of the sash guide and pivot member, and resilient means urging the extension toward the guiding frame rail in assembly whereby on movement of the movable window sash into a limiting position toward the fixed frame rail the flexible extension on the sash guide and pivot member is cammed over a sash balance show positioned in the guiding frame rail to lock the sash guide and pivot member and the sash balance show together.

3. Structure as set forth in claim 2, wherein the flexible extension is integral with the sash guide and pivot member.

4. Structure as set forth in claim 2, wherein the window structure further includes a sash balance positioned in a pocket in a guiding rail including a sash balance torsion ribbon having an offset portion at the end thereof and a sash balance show including recesses on two sides thereof extending in the direction of the guiding frame rail and a centrally located slot extending between the recesses constructed to receive the offset end of the sash balance torsion ribbon.

5. Structure as set forth in claim 4 wherein the sash balance shoe further includes a surface on one side thereof for engagement with an inside surface of the guiding frame rail on one side of the pocket therein and a surface on the other side of the pocket therein and a surface on the other side thereof for engagement wth an outside surface of the guiding frame rail on the other side of the pocket therein with the sash balance torsion ribbon being stressed to rotate the sash balance shoe toward the other side of the pocket on the outside of the pocket.

6. Structure as set forth in claim 28, wherein the sash balance shoe further includes an arcuate side portion for permitting rotation of the sash balance shoe into the pocket in installation.

7. Structure as set forth in claim 5, wherein the sash balance shoe further includes an extension on the bottom thereof having an opening therein for receiving the pivot portion of the sash guide and pivot member.

8. Structure as set forth in claim 7, wherein the opening in the extension on the bottom of the sash balance shoe is spilt at the bottom thereof and the edge portions at the spilt in the opening are arcuate toward the sash balance shoe to permit entry of the pivot portion of the sash guide and pivot member on spreading of the sides of the sash balance shoe extension apart by movement of the movable sash into a limiting position toward the fixed frame rail.

9. Sash guide and pivot structure comprising a rectangular portion adapted to fit within a window sash guide rail at the one end of the lock rail thereof, an L-shaped flange on perpendicular sides of the rectangular portion for engaging the side and end of the sash guide rail and an elongated noncircular pivot portion extending on the opposite side of the flange from the rectangular portion of the sash guide and pivot member.

10. Sash guide and pivot structure comprising a rectangular portion adapted to fit within a window sash guide rail at the one end of the lock rail thereof, an L-shaped flange on perpendicular side of the rectangular portion for engaging the side and end of the sash guide rail, an elongated non-circular pivot portion extending on the opposite side of the flange from the rectangular portion of the sash guide and pivot member and a flexible extension secured to the flange portion of the sash guide and pivot structure and extending away from the rectangular and pivot portions of the sash guide and pivot structure including a balance shoe retaining barb on the outer end thereof projecting in the same direction as the pivot portion of the sash guide and pivot member.

11. Structure as set forth in claim 10, wherein the flexible extension is integral with the sash guide and pivot member.

12. A sash balance shoe including vertically extending recesses on two sides thereof and a centrally located slot extending therebetween constructed to receive the offset end of a sash balance torsion ribbon.

13. A sash balance shoe including vertically extending recesses on two sides thereof and a centrally located slot extending therebetween constructed to receive the offset end of a sash balance torsion ribbon, which sash balance shoe further includes a surface on one side thereof for engagement with an inside surface of a guiding frame rail on one side of a pocket therein and a surface on the other side thereof for engagement with an outside surface of a guiding frame rail on the other side of the pocket therein with the sash balance torsion ribbon being stressed to rotate the sash balance shoe toward the other side of the pocket on the outside of the pocket.

14. Structure as set forth in claim 13, wherein the sash balance shoe further includes an arcuate side portion for permitting rotation of the sash balance shoe into the pocket in installation.

15. Structure as set forth in claim 13, wherein the sash balance shoe further includes an extension on the bottom thereof having an opening therein for receiving the pivot portion of a sash guide and pivot member.

16. Structure as set forth in claim 15, wherein the opening in the extension on the bottom of the sash balance shoe is split at the bottom thereof and the edge portions at the split in the opening are arcuate toward the sash balance shoe to permit entry of the pivot portion of the sash guide and pivot member on spreading of the sides of the sash balance shoe extension apart on movement of the sash guide and pivot member toward the sash balance shoe. other side of the pocket on the outside of the pocket.

17. Window structure for installation both as a single-hung window or as a hopper window and as a right or left-hand glider window including a frame having a fixed frame rail, guiding frame rails, a locking frame rail and a frame check rail, at least one movable sash secured within the frame for selective movement in the plane of the window frame and tilting out of the plane of the window frame about one edge of the sash including a tilt rail, guide rails having longitudinal recesses therein and a lock rail, and sash guide and pivot structure positioned at least partly within the longitudinal recesses of the sash guide rails and secured to opposite corners of the movable sash, spacing the movable sash from the guiding frame rails, finishing the ends of the movable sash guide rails at the ends of the sash lock rail to prevent damage to weather stripping on pivoting of the movable sash about the lock rail thereof and providing a pivot axis for the movable sash on pivoting thereof, which sash guide and pivot structure is operable to lock the movable sash in a pivoted position with respect to movement of the movable sash along the frame.

18. Window structure including a frame having a fixed frame rail, guiding frame rails, a locking frame rail and a frame check rail, at least one movable sash secured within the frame for selective movement in the plane of the window frame and tilting out of the plane of the window frame about one edge of the sash including a tilt rail, guide rails having longitudinal recesses therein and a lock rail, sash guide and pivot structure positioned at least partly within the longitudinal recesses of the sash guide rails and secured to opposite corners of the movable sash, spacing the movable sash from the guiding frame rails, finishing the ends of the movable sash guide rails at the ends of each lock rail to prevent damage to weather stripping on pivoting of the movable sash about the lock rail thereof and providing a pivot axis for the movable sash on pivoting thereof, which sash guide and pivot structure is operable to lock the movable sash in a pivoted position with respect to movement of the movable sash along the frame, and a sash balance shoe positioned within at least one of the guiding frame rails and engaged with a portion of the sash guide and pivot structure whereby the sash balance shoe is releasably secured in position against the bias of a sash balance secured thereto.

19. Sash guide and pivot structure comprising a rectangular portion adapted to fit within a window sash guide rail and a substantially flat flexible extension secured to the rectangular portion adapted to extend substantially flat against a window sash guide rail including a balance shoe retaining barb on the outer end thereof extending away from the rectangular portion thereof.

20. A sash balance shoe comprising a generally rectangular member having vertically extending recesses on two sides thereof and a centrally located slot extending therebetween constructed to receive the offset end of a sash balance torsion ribbon and having a substantially flat top for engagement with a retaining barb.

21. Window structure including a frame having a fixed frame rail, guiding frame rails, a locking frame rail and a frame check rail, at lest one movable sash secured within the frame for selective movement in the plane of the window frame and tilting out of the plane of the window frame about one edge of the sash including a tilt rail, guide rails and a lock rail, sash guide and pivot structure secured to opposite corners of the movable sash for spacing the movable sash from the guiding frame rails, for finishing the ends of the movable sash guide rails at the ends of each lock rail to prevent damage to weather stripping on pivoting of the movable sash about the lock rail thereof and providing a pivot axis for the movable sash on pivoting thereof, which sash guide and pivot structure is operable to lock the movable sash in a pivoted position with respect to movement of the movable sash along the frame, and a sash balance shoe positioned within at least one of the guiding frame rails and engaged with a portion of the sash guide and pivot structure includng vertically extending recesses on two sides thereof and a centrally located slot extending therebetween constructed to receive the offset end of a sash balance torsion ribbon and a substantially flat top for engagement with a retaining barb whereby the sash balance shoe is releasably secured in position against the bias of a sash balance secured thereto.

22. Window structure including a frame having a fixed frame rail, guiding frame rails, a locking frame rail and a frame check rail, at least one movable sash secured within the frame for selective movement in the plane of the window frame and tilting out of the plane of the window frame about one edge of the sash including a tilt rail, guide rails and a lock rail, sash guide and pivot structure secured to opposite corners of the movable sash for spacing the movable sash from the guiding frame rails, finishing the ends of the movable sash guide at the ends of each lock rail to prevent damage to the weather stripping about the lock rail thereof and providing a pivot axis for the movable sash on pivoting thereof, which sash guide and pivot structure is operable to lock the movable sash in a pivoted position with respect to the movement of the movable sash along the frame, including a rectangular portion adapted to fit within a window sash guide rail and a flexible extension extending from the rectangular portion including a balance shoe retaining barb on the outer end thereof, resilient means operable between the window sash guide rail and flexible extension for biasing the flexible extension away from the window sash guide rail, and a sash balance shoe positioned within at least one of the guiding frame rails and engaged with the flexible extension of the sash guide and pivot structure whereby the sash balance shoe is releasably secured in position by means of the retaining barb against the bias of a sash balance shoe secured thereto.

* * * * *